US006428851B1

(12) United States Patent
Friedersdorf et al.

(10) Patent No.: US 6,428,851 B1
(45) Date of Patent: Aug. 6, 2002

(54) METHOD FOR CONTINUOUS THERMAL DEPOSITION OF A COATING ON A SUBSTRATE

(75) Inventors: Fritz J. Friedersdorf, Hellertown; Rangarajan Venkataraman, Bethlehem; Michael J. Danilich, Bethlehem; Kuo-Chin Chou, Bethlehem; George E. Donchez, Allentown; Jay D. Hoffman, Catasauqua; Thomas A. Suchy, Quakertown, all of PA (US)

(73) Assignee: Bethlehem Steel Corporation

( * ) Notice: Subject to any disclaimer, the term of this patent is extended or adjusted under 35 U.S.C. 154(b) by 0 days.

(21) Appl. No.: 09/517,064

(22) Filed: Mar. 1, 2000

(51) Int. Cl.[7] ..... B05D 1/18; B05D 3/02; B05D 3/12; B05D 1/36

(52) U.S. Cl. ..... 427/318; 427/209; 427/327; 427/348; 427/372.2; 427/405; 427/434.2; 427/434.4; 427/434.6; 427/435; 427/424

(58) Field of Search ..... 427/318, 327, 427/372.2, 348, 405, 434.2, 434.4, 434.6, 435, 424, 209

(56) References Cited

U.S. PATENT DOCUMENTS

| | | | | |
|---|---|---|---|---|
| 3,094,435 A | | 6/1963 | Schuster et al. | 117/132 |
| 3,132,055 A | | 5/1964 | Tanaka et al. | 148/6.16 |
| 3,140,204 A | | 7/1964 | Tokunaga et al. | 148/6.2 |
| 3,891,471 A | | 6/1975 | Summers et al. | |
| 3,909,953 A | * | 10/1975 | Hemsath et al. | 34/26 |
| 4,189,356 A | * | 2/1980 | Merony et al. | 204/25 |
| 4,326,894 A | * | 4/1982 | Konnert | 148/6.14 R |
| 4,690,837 A | * | 9/1987 | Doroszkowski et al. | 427/314 |
| 5,039,360 A | * | 8/1991 | Brugarolas et al. | 148/251 |
| 5,099,780 A | * | 3/1992 | Nappier et al. | 118/33 |
| 5,283,280 A | | 2/1994 | Whyte et al. | 524/559 |
| 5,635,555 A | | 6/1997 | Vranken et al. | 524/407 |
| 5,641,543 A | | 6/1997 | Brooks | |
| 5,919,517 A | | 7/1999 | Levendusky et al. | 427/211 |

FOREIGN PATENT DOCUMENTS

| | | |
|---|---|---|
| DE | 196 23 495 A1 | 12/1997 |
| DE | 196 25 548 A1 | 1/1998 |
| GB | 1029822 | 5/1966 |
| WO | WO 0 029 792 A1 | 6/1981 |
| WO | WO 0 619 146 A1 | 10/1994 |

OTHER PUBLICATIONS

International Search Report for PCT/US00/29841 claiming priority based upon the present U.S. Appln. No. 09/517,064.

* cited by examiner

*Primary Examiner*—Michael Barr
(74) *Attorney, Agent, or Firm*—Harold I. Masteller, Jr.

(57) ABSTRACT

Continuous bath or curtain processes for the thermal deposition of a coating from a coating solution onto a moving metal web are used to apply a coating onto the web. The compositions that result from the processes are substantially free of defects relative to batch processes. The continuous process is particularly applicable for priming zinc and zinc-alloy coated steel webs.

49 Claims, 7 Drawing Sheets

METHOD FOR CONTINUOUS THERMAL DEPOSITION OF A COATING ON A SUBSTRATE

BACKGROUND OF THE INVENTION

1. Field of the Invention

The present invention relates to a method for continuous application of a primer coating and the continuous primed strip product therefrom. More particularly, the invention is directed to a continuous thermal deposition method for applying a primer coating to the surface of a hot-dip or electroplated zinc or zinc alloy coated steel strip at an elevated strip temperature. The continuous thermal deposition coating method of the present invention allows rapid coating of large areas of the strip surface resulting in a continuously coated product having minimal defects. The method and product of the present invention are more environmentally conscious (eco-efficient), and provide a means for improved finished sheet product quality at reduced cost. The method and product of the present invention are particularly useful for coating metal sheet used in the manufacture of certain finished and semi finished products for the metal building industry.

2. Brief Description of the Related Art

Numerous compositions and methods have been used in the past to coat sheet metal surfaces such as steel, iron, aluminum and the like, to reduce the effects of environmental degradation (weathering) and enhance appearance. In the steelmaking industry, hot-dip and electroplated zinc and zinc-alloy coatings are applied to the surface of steel sheets in continuous hot-dip coating and electroplating lines to produce corrosion resistant products, for example hot-dip galvanized, aluminized, Galvalume®, galvanneal, electrogalvanized and zinc nickel electrogalvanized sheet steel products. The name Galvalume as used herein refers to a zinc hot-dip coating comprising 55% aluminum. Zinc and zinc alloy coated sheet steel products are normally formed into finished consumer products that require a durable, high quality painted surface to satisfy customer demands. Such high quality finished products range from architectural products such as roofing and siding, household products that include simple items to major appliances and furniture, and automotive products, such as interior and exterior body panels, and the like.

Currently, steel producers deliver coils of unpainted zinc or zinc alloy coated sheet to a continuous coil coater operation for production of fully painted sheet that is subsequently formed into finished consumer products. The zinc or zinc alloy coated products require steel-mill applied vanishing oil and/or chromate passivation coatings to minimize corrosion or weathering of the zinc or zinc alloy coating during transit and storage prior to painting. At the coil coater operation the steel sheet product is uncoiled, abrasively brushed, chemically cleaned, and pretreated with aqueous solutions to form tricationic zinc phosphate, hexavalent chromium, or complex oxide compounds on the zinc or zinc alloy surface. The sheet is then water rinsed and dried prior to painting with a primer coat and at least one finish coat (topcoat). Each of the numerous process steps at the steel mill and coil coater operation poses environmental, health and safety concerns. The current typical arrangement, in which steel sheet is coated with zinc or zinc alloy and a full paint system in separate steel mill and coil coater facilities, is inefficient and environmentally unfriendly, yielding hazardous waste streams that may contain persistent, bio-accumulative and toxic substances from both facilities. Combination of some all of the process steps into a single facility would significantly increase the overall efficiency as well as the eco-efficiency of the production of painted zinc or zinc alloy coated sheet products.

Several patents identify coating processes that apply paint or veneer-like coatings to metal surfaces. Patents that have addressed continuously applied coatings include U.S. Pat. No. 5,807,434 to Innes, which discloses an apparatus for two-sided paint and lubricant type coatings to elongated articles, and U.S. Pat. No. 5,919,517 to Levendusky et al., which discloses a method for applying a thermoplastic polymer resin coating to a metal strip. Neither of these patents addresses thermal deposition in applying the coating. U.S. Pat. No. 4,690,837 to Doroszkowski et al. discloses an organic coating process in which the heated surface of an article to be coated comes into contact with a coating solution bath. The articles being coated with the organic coating are immersed singly or passed sequentially through the coating solution bath. The batch processing of Doroszkowski et al. requires individual handling of each article to be coated. This increases the potential for imperfections within the finished articles, decreases the efficiency of the process, and is not practical for coating extremely long or continuous parts.

U.S. Pat. No. 5,039,360 to Brugarolas et al. discloses a method for coating a continuously moving heated metal surface using a spray gun. Spray guns impinge droplets of coating solution onto the moving metal substrate. The application and flow of enough overlapping droplets onto the moving metal surface eventually results in the formation of a uniform coating film with complete coverage of the moving metal surface. The thickness of the coating is determined by the amount of liquid coating solution applied to the strip. Brugarolas discloses a two component coating solution that cannot be recycled after mixing because of the irreversible reaction of the two components. The spray contains hexavalent chromium compounds and over spray or excess coating solution cannot be recirculated back into the spray system. Therefore, over spray and excess coating solution is a hazardous waste, and spray mists and vapors adversely impact industrial hygiene. Additionally, spray application of a coating onto the surface of a heated metal substrate creates a diffuse area of contact between the portion of the strip that has been sprayed with coating solution and the portion of the strip that has not been sprayed with coating solution. When a spray droplet impinges on a heated moving metal surface, the droplet will absorb heat from an adjacent volume of the substrate. As additional droplets impinge upon the surrounding surface, there may not be as much heat energy available in the substrate to support thermal coating deposition. The resulting uneven heat absorption may cause non-uniform deposition of the coating onto the substrate. Such spray application of coating solution cannot be used in conjunction with continuous thermal deposition because the diffuse contact area, in combination with the application of discrete droplets of coating solution, produce an uneven coating and/or coating bare spots along the surface of the heated moving metal substrate. Finally, Brugarolas teaches spray application of an acrylic organic polymer primer with a coating composition, or coating solution, containing about 20–40% by weight solids, onto a substrate heated to a temperature of between 40° C. to 250° C. The improved thermal deposition process of the present invention is capable of applying a uniform organic coating as thin as 0.5 micron on a continuous moving metal substrate heated to 204° C. using a coating solution containing as little as 0.5% by weight solids.

U.S. Pat. No. 5,283,280 to Whyte et al. discloses a method for applying a polymer coating to heated objects by quenching them in a heated bath of coating solution. The heated bath of coating solution contains 2%–40% solids. Similar to Doroszkowski, the disclosed batch processing requires that each object be hung or supported individually, thereby increasing the potential for imperfections in the finished objects, decreasing the efficiency of the process and being impractical for large or continuous parts. The individual objects are placed into the bath for 15–120 seconds. The deposited coatings are disclosed to be fully dry upon removal of the object from the coating bath. In continuous thermal deposition, the coating solution does not require heating, and in some instances, the coating solution must be cooled in order to maintain a desired temperature that will maintain stability of the coating solution. Coating solutions with bath solids as low as 0.5% have been found to produce uniform organic coatings as thin as 0.5 microns. No lower limit on the contact time has been observed for the formation of a continuous thermal deposited coating, with contact times of 3 seconds being employed to deposit organic coatings. These continuous thermal deposited coatings are not dry when they are removed from the coating solution and usually require drying or curing.

Thus, each of the earlier processes discussed above has one or more shortcomings that the present invention addresses. The thermal deposition process embodied in the present invention provides for efficient, environmentally-friendly, non-contact, continuous, uniform coating of a self-supported moving sheet or web. The product embodied by the present invention is efficiently produced, more environmentally friendly, and has lower probability of handling defects than products that are manufactured using earlier coating processes.

SUMMARY OF THE INVENTION

It is an object of the present invention to provide a process for applying a continuous coating on a moving metal web by heating at least a portion of the moving metal web to a target temperature sufficient to deposit a coating on a surface thereof, and by applying a coating solution to the heated portion of the moving metal web, the applied coating solution forming the continuous coating on contact with the heated portion.

It is a further object of the present invention to provide an improved web product made by the process for applying a continuous coating to a moving metal web by heating at least a portion of the moving metal web to a target temperature sufficient to deposit a coating and applying a coating solution to the heated portion of the moving metal web to form a continuously coated web product.

It is still a further object of the present invention to provide a web product that is primed by a thermal deposition process comprising the steps of heating at least a portion of a moving unprimed web to a target temperature sufficient to deposit a primer coating and applying a primer coating solution to the heated portion of the moving web to produce a primed web surface.

It is another object of the present invention to provide an in-process coating and web product comprising a moving metal web having an unfinished portion, a finished portion, and an interim segment located between the unfinished and finished portions wherein the unfinished end of the moving metal web includes an uncoated heated portion moving toward a substantially straight line of contact with a coating solution, the interim segment of the moving metal web includes a portion having a substantially straight line of contact with the coating solution across a width of the moving metal web and a portion having an uncured and/or undried coating deposited thereon, and a portion moving through a curing and/or drying apparatus, and the finished end of the moving metal web includes the portion moving away from the curing and/or drying apparatus and including a cured and/or dried coating deposited thereon, the unfinished portion of the moving metal web continuously moving towards the finished portion of the moving metal web.

It is still another object of the present invention to provide a process that is particularly applicable for the deposition of priming compositions onto a zinc or zinc alloy coated steel substrate. Examples of such a primed product include primed galvanized sheet steel that is finish coated on a coil paint line and used as an exterior wall component, Galvalume sheet steel product that is coated with a mill-applied clear organic film and is roll formed into roof panels that receive no further organic coatings, and a primed galvanized steel product that is roll formed and fabricated into door frames that are finish painted after installation.

DETAILED DESCRIPTION OF THE PREFERRED EMBODIMENT

Figure 1:
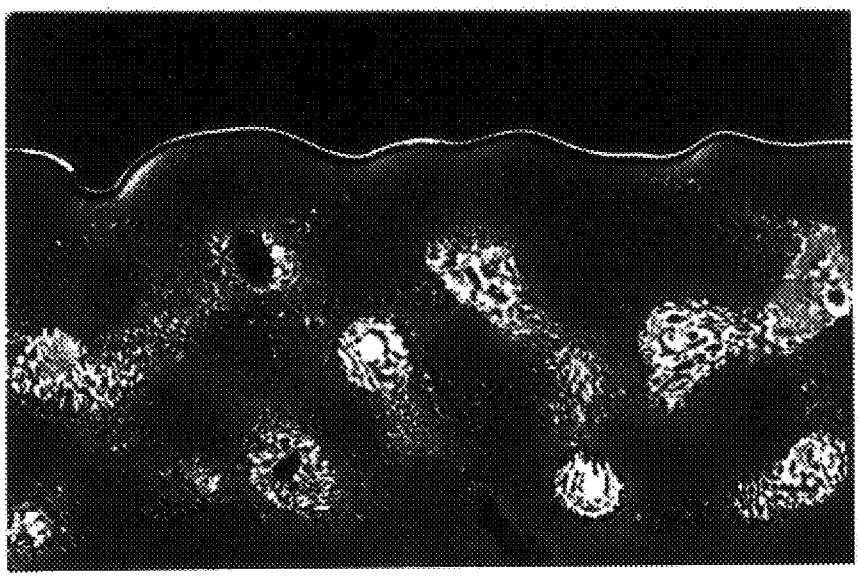
FIG. 1 is a photomicrograph showing a thermally deposited acrylic coating applied to a hot-dip Galvalume coating on steel.

The present invention includes a continuous process for applying a coating to a heated moving metal web, and the resulting web products manufactured therefrom. This process comprises continual passage of a self-supporting web substrate through a bath or curtain of coating solution, resulting in an even, uniform, complete coating on the web substrate with minimal imperfections or defects. The application of the coating is achieved through thermal deposition from the coating solution onto the moving heated metal web substrate. The thermal deposition process results in a coating that completely covers the surface of the moving metal web, regardless of the quality of the web shape and surface. The continuous thermal deposition applies coatings of organic, inorganic or hybrid resins and binders, pigments, corrosion inhibiting compounds, fillers and other like compositions onto the moving metal web. The thermally deposited coatings are used for improved corrosion resistance, wear, lubricity, formability, adhesion and/or aesthetic purposes on metal, alloy, hot-dip coated, electroplated, or other like substrates. Substrates may be in the form of continuous strip or sheet, rods, tubing, wire, bands or other materials suited for processing in a continuous self-supported line.

The present invention is particularly directed to the application of a primer coat to zinc or zinc alloy coated steel sheet in a continuous hot-dip coating line prior to delivery of the product to a coil coater. With the application of the primer coat at the continuous hot-dip coating facility, prior to coil shipment to a coil coater operation, the eco-efficiency of the finished coil coated product is significantly improved by the elimination of volatile organic compounds (VOCs) and corrosion inhibiting compounds associated with vanishing oils, passivates containing carcinogenic chromium compounds, and zinc and chromium compound containing sludge from abrasive brushing at the coil coater operation, the minimization of the use of alkaline cleaning chemicals, and the potential elimination of pretreatment chemicals and rinses that result in solid and liquid waste streams containing aqueous solutions of nickel, manganese and zinc phosphates, and/or hexavalent chromium, and/or titanium and molybdenum compounds. The present invention significantly reduces environmental concerns, allows the coil coater to produce a conventional prepainted product by only applying a finish paint coat on top of the pre-primed surface, and allows most coil coaters to produce prepainted product with more complex three-coat systems in a single line pass.

For the purposes of the present invention, thermal deposition refers to the application of a coating onto the surface of a substrate having an elevated temperature, where the heat of the substrate causes solids within the coating solution to be, and remain, deposited onto a surface of the substrate. It is believed that the heat at the substrate surface causes rapid local vaporization of the volatile components of the coating solution on contact, leaving the non-volatile components of the coating solution to adhere directly to the substrate surface. Continuous thermal deposition of the coating onto the heated, moving metal substrate is accomplished using a bath or curtain of the coating solution. A section of the moving metal web that has been heated to a predetermined temperature enters into and is exposed to the coating solution comprising the bath or curtain. The web temperature determines the amount of heat energy available in the moving metal web section for deposition of a coating from the coating solution. The simultaneous thermal deposition of the coating solution solids and expulsion of solvent vehicle from the deposited coating result in complete surface coverage and excellent primer adhesion to the substrate without pretreatment. These film primer properties, in turn, impart good corrosion resistance and other properties to the coated substrate.

The continuous thermal deposition process of the present invention allows for the complete coating of surfaces without the necessity of batch handling and without the inefficient, non-uniform application method of spraying. Imperfections within the surface of the substrate are completely coated using thermal deposition. The thermal deposition process using dilute (0.5 wt. % solids) coatings solutions can produce extremely thin (<1.0 $\mu$m) polymer films with complete and uniform surface coverage. For example, FIG. 1 shows a scanning electron microscope photomicrograph of a metallographically prepared cross section of hot-dip Galvalume coating on steel with a 0.5 micron thick acrylic coating that was thermally deposited from a 0.5 wt.% solids aqueous solution onto the Galvalume substrate heated to 204° C. The acrylic-coated Galvalume coating was sputtered with gold to better delineate the outermost surface of the sample. The photomicrograph clearly shows the acrylic coating uniformly covering the uneven Galvalume surface. Thermal deposition at higher substrate temperatures and/or of higher solids coating solutions (>10 wt. % solids) can also minimize transference of substrate imperfections or defects to the surface of the primer coating, and ultimately to the finish painted surface of the final product.

Figure 2:
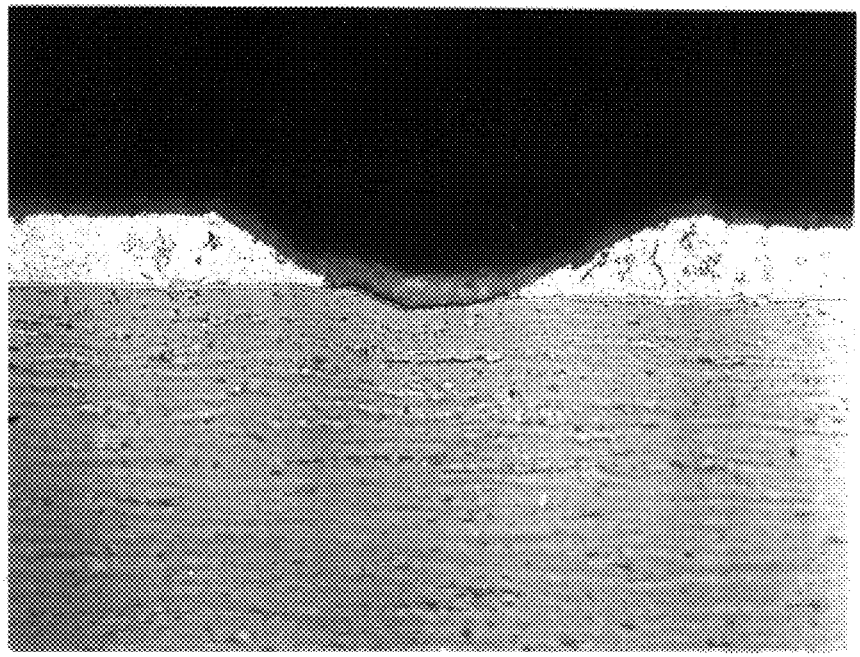
FIG. 2 is a photomicrograph showing a thermally deposited primer covering the surface of a hot-dip Galvalume coating on steel.

FIG. 2 is another photomicrograph of a metallographically prepared cross section of a hot-dip Galvalume coated steel sheet. The photomicrograph shows complete primer coverage achieved in and around a surface defect by thermal deposition coating. Thermal deposition coating of thicker films (approximately 5 microns) results in heavier deposits within surface concavities as shown in the figure. Thermally deposited coatings cover aspirities (convex surface features) and do not de-wet and flow away from these surface features due to surface tension induced flow, as shown FIGS. 1 and 2. Small concavities, recessed or indented areas, i.e., scratches or pits, have relatively low ratios of surface area to thermal interaction volume compared to convex features, raised flaps, or ridges, which have higher ratios of surface area to thermal interaction volume. Consequently, concavities have more heat energy available for thermal coating deposition, and raised defects have slightly lower heat energy available for thermal coating deposition. The overall effect is that the surface of a depressed defect or pit cools more slowly, and therefore receives a thicker thermally deposited coating than the surface of a raised defect of the same geometry. Therefore, a thermally deposited coating is smoother than its substrate, resulting in improved appearance and ease of application of subsequent coatings. Additionally, large surface areas may be processed while maintaining ease of control and heating efficiency compared with other methods by continuously exposing a small portion of the total moving web to the bath or curtain of solution. Additionally, the thermal deposition process maintains efficiency from heat loss as compared with other coating methods, for example, the methods disclosed in the above prior patents. The unexpected improvement in efficiency from heat loss enables a manufacturer to coat or pre-prime much larger substrate surface areas than heretofore-possible using state-of-the-art technology. Finally, because the substrate comprises a self-supported continuous web, it is not necessary to use supporting devices such as hangers or hooks to convey the substrate into and through the coating solution bath. This eliminates surface defects and/or substrate waste that occur when hooks and hangers block the coating process and prevent proper coating application at localized areas on the substrate.

The coating solution may be varied to suit particular needs, such as coating type, thickness, coloration, texture, and other like characteristics. As such, an in-process coating and web product for applying a coating onto a continuous web is created during the process of the present invention.

The moving metal web comprises an unfinished portion, a finished portion, and an interim segment located between the unfinished and finished portions. The finished end comprises a portion of the moving metal web with a cured and dried coating deposited thereon, whereas the unfinished end lacks this coating. The interim segment, located between the unfinished end and the finished end, comprises a portion of the moving metal web that is being exposed to the bath or curtain of coating solution and a portion of the moving metal web passing through the curing or drying apparatus. Coating solution is applied and cured/dried thereon with the unfinished web portion progressing towards the essentially straight line of contact with the bath or curtain of coating solution and the finished portion of the interim segment of the moving metal web continuously moving out of the curing/drying apparatus.

Figure 3:
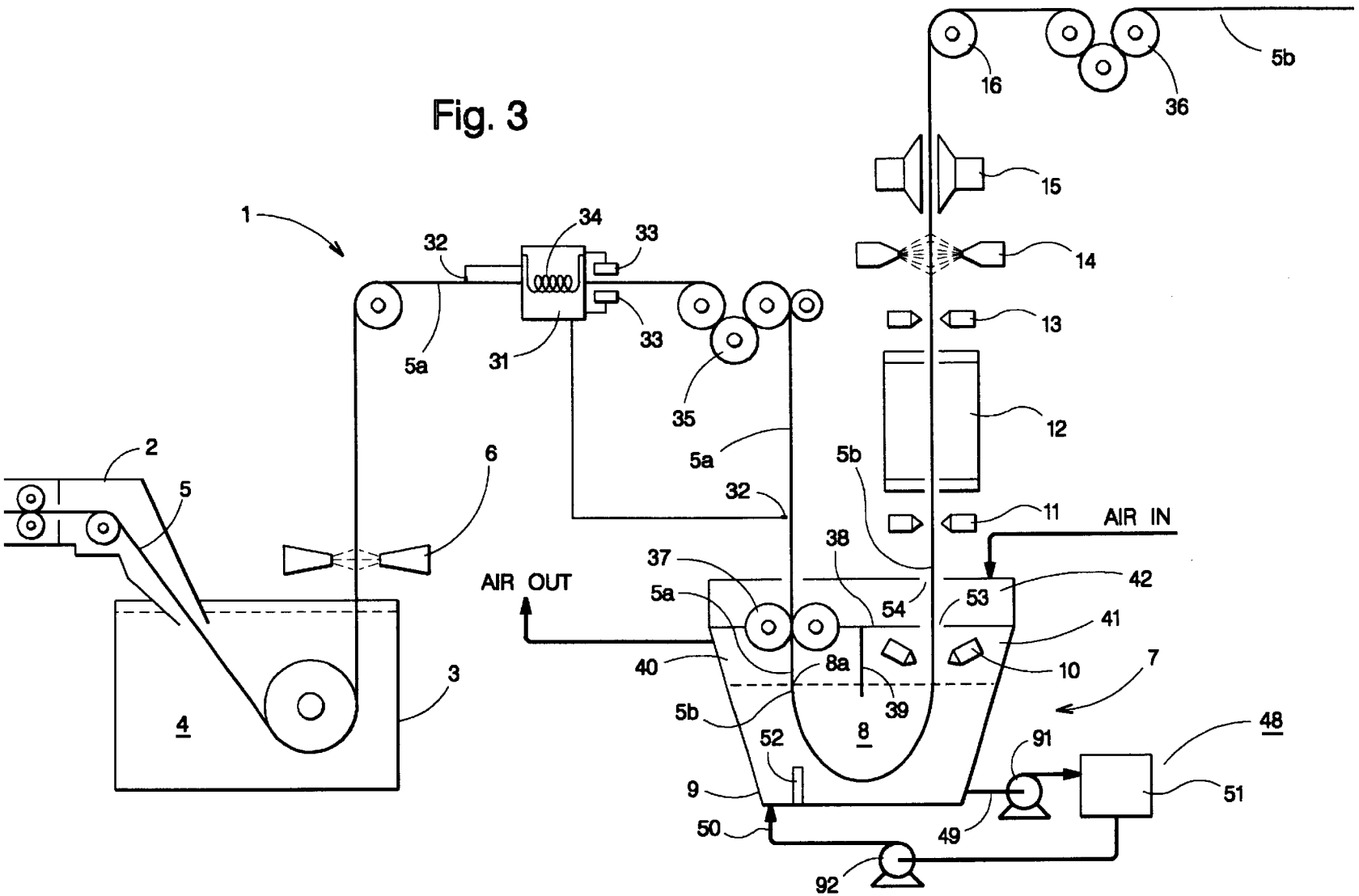
FIG. 3 is a schematic view of the present invention showing an immersed loop coater applying a thermal deposition coating to a moving substrate in a continuous hot-dip coating line.

Referring to FIG. 3, the drawing shows a first embodiment of the present invention comprising a continuous hot-dip coating line 1, for example, but not limited to, a Galvalume line, including an entry end snout 2 and coating pot 3 containing a hot-dip bath 4 where a Galvalume coating is applied to continuous web 5 running at high speed through the hot-dip coating line 1. The high hot-dip bath temperature of about 600° C. heats the continuous web 5 to a temperature greater than a selected target temperature suitable for application of a thermal deposition coating downstream from coating pot 3. Air knives 6 are provided at the exit end of the coating pot to wipe excess molten Galvalume coating from substrate 5 before it solidifies, and a supplemental temperature regulating apparatus 31 may be positioned upstream from immersed loop coater 7 to maintain the correct target temperature in the unfinished portion 5*a* of the moving metal web substrate for immersion into the thermal deposition coating solution 8 contained in the immersion tank 9 of immersed loop coater 7. A thermal deposition coating is applied to the surface of the Galvalume coating in the interim segment 5*b* of the moving metal web as the preheated unfinished portion 5*a* is substantially immersed at a straight line of contact with the thermal deposition coating solution 8 at immersion plane 8*a*. Air knives 10 at the exit side of the loop coater 7 wipe excess coating solution 8 from the interim segment portion 5*b* before it enters a curing or drying oven 12. Air nozzles 11 and 13 are used to maintain the position and stability of the continuous moving web 5*b* through the curing oven 12. Water mist spray nozzles 14 and/or blower 15 may be used to cool the continuous moving metal web 5*b* prior to contacting the turn roll 16. In the case of cooling by water mist jets 14, the coated continuous moving metal web 5*b* is further cooled and/or dried using the blowers 15. The flow rates of the water mist jets 14 are metered to avoid excessive water rundown. The finished web portions 5*b* are processed downstream for shipping.

Figure 4:
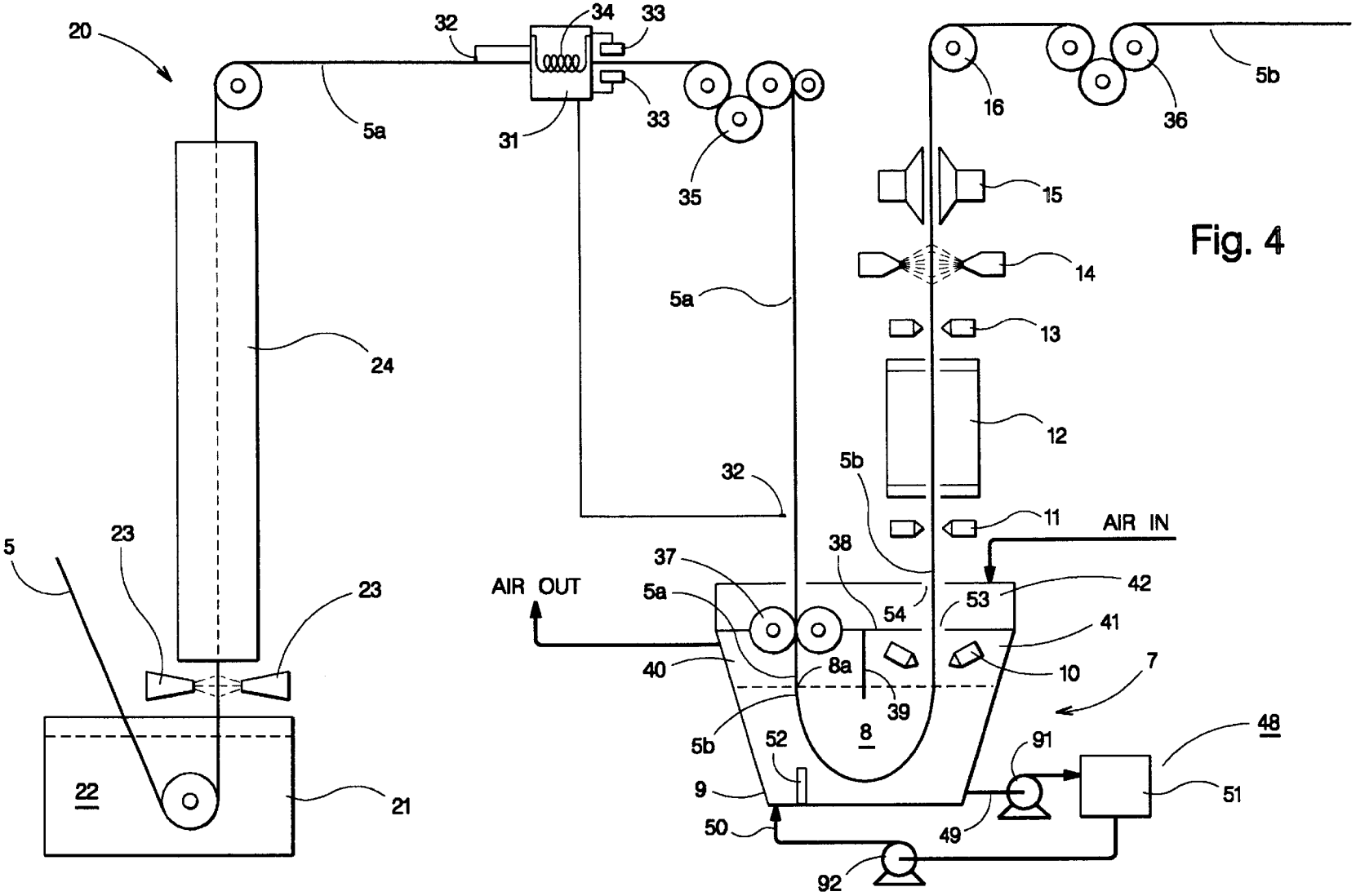
FIG. 4 is a schematic view similar to FIG. 3 showing an immersed loop coater applying a thermal deposition coating to a moving substrate in a continuous galvanneal line.

Referring to FIG. 4 of the drawings showing a second exemplary embodiment of the present invention comprising a continuous hot-dip coating line 20, for example, but not limited to, a galvanneal line, including a coating pot 21 containing a hot-dip bath 22 where a molten zinc coating is applied to continuous web 5 running at high speed through the hot-dip coating line. Air knives 23 at the exit end of the coating pot wipe excess molten zinc from substrate 5 and the continuous moving web 5 enters a furnace or heating chamber 24 to alloy the zinc coating with the base metal to form a zinc-iron alloy "galvanneal" coating on the surface of the unfinished continuous web portion 5*a* moving toward the thermal deposition coating process. The high temperatures in furnace 24 beat the unfinished continuous moving web portion 5*a* to a temperature greater than a selected target temperature suitable for applying a thermal deposition coating to the galvanneal coating at a location downstream from the furnace 24. In a manner similar to the embodiment disclosed in FIG. 3, a supplemental temperature regulating apparatus 31 may be positioned upstream from immersed loop coater 7. A thermal deposition coating is applied to the surface of the hot-dip coating at the immersion plane 8*a* where the preheated substrate portion 5*a* enters the thermal deposition coating solution 8 at target temperature. Air knives 10 at the exit side of the loop coater 7 wipe excess coating solution 8 from the interim substrate portion 5*b* before it enters a curing oven 12. Air nozzles 11 and 13 are used to maintain the position and stability of the continuous moving web 5*b* through the curing oven 12. Water mist spray nozzles 14 and blower 15 may be used to cool the continuous moving metal web 5*b* prior to contacting the turn roll 16. In the case of cooling by water mist jets 14 the coated continuous moving metal web 5*b* is further cooled and/or dried using the blowers 15. The flow rates of the water mist jets 14 are metered to avoid excessive water rundown. The finished web portions 5*b* are processed downstream for shipping.

Figure 5:
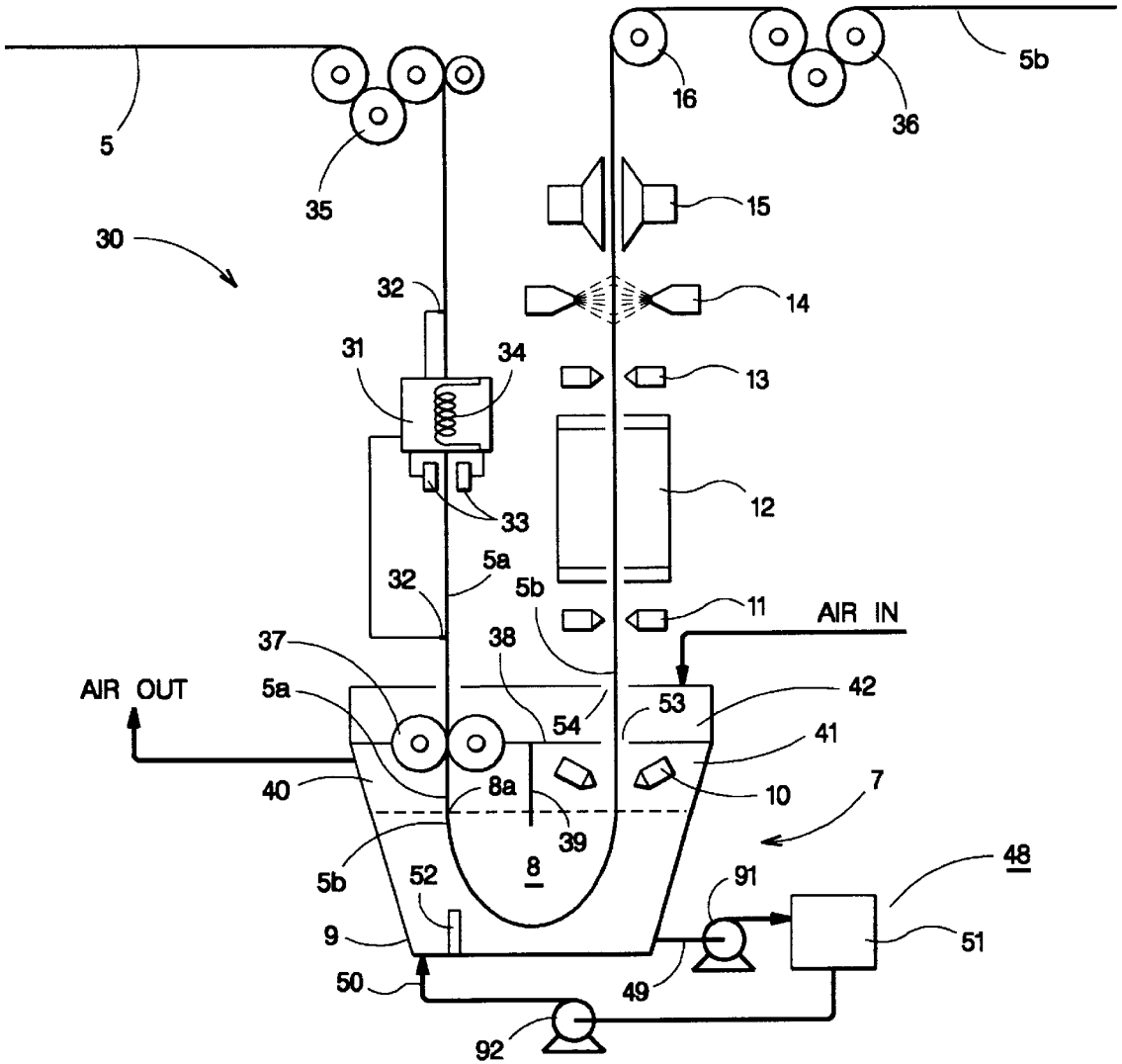
FIG. 5 is a schematic view similar to FIGS. 3 and 4 showing an immersed loop coater applying a thermal deposition coating to a moving substrate in a continuous coating line that does not comprise latent heat from a previous in-line process.

Referring to FIG. 5 showing a third exemplary embodiment of the present invention comprising a continuous line 30 for applying a thermal deposition coating to a continuous moving web 5 that is not heated in a processing step such as hot-dip coating, galvannealing or annealing immediately prior to the application of a thermal deposition coating. The substrate includes, for example, but is not limited to, steel, aluminum, copper, brass, or the like. The embodiment comprises a temperature regulating apparatus 31 for heating the continuous moving web 5 to a selected target temperature suitable for applying the thermal deposition coating of the present improved process. The unfinished web portion 5*a* exits the temperature regulating apparatus 31 and is immersed at target temperature into a thermal deposition coating solution 8 contained within tank 9 of immersed loop coater 7 where a thermal deposition coating is applied to the surface of the continuous moving web 5*a* at immersion plane 8*a*. Air knives 10 at the exit side of the loop coater 7 wipe excess coating solution 8 from the interim substrate portion 5*b* before it enters curing oven 12. Air nozzles 11 and 13 are used to maintain the position and stability of the continuous moving web 5*b* through the curing oven 12. As previously described herein, water mist spray nozzles 14 and blower 15 may be used to cool the continuous moving metal web 5*b* prior to contacting the turn roll 16. The finished web portions 5*b* are processed downstream for shipping.

FIGS. 3–5 show various embodiments for carrying out the steps of the present invention for applying a continuous thermal deposition coating to a heated substrate, the steps of the process including immersing a metal substrate in the form of a continuously moving metal web 5*a* into a coating solution bath 8 contained in an immersed loop coater 7. The coating is applied to the moving interim metal web portion 5*b* after a section or length of the moving unfinished metal web portion 5*a* has been heated to a selected target temperature suitable for application of the thermal deposition coating. As one heated moving metal web section 5*a* is immersed in the coating solution 8 at immersion plane 8*a*, another heated moving metal web section 5*a* follows, with additional heated moving metal web sections 5*a* recurring continuously for an indefinite period of time. The temperature difference between the web portion and the thermal deposition coating solution 8 is at a maximum where the preheated web portion 5*a* is immersed into the thermal deposition coating solution 8 at the immersion plane 8*a*.

The continuous substrate 5 may comprise any suitable metal composition that possesses sufficient flexibility, thermal stability, and self-supporting resilience at the process temperatures required for thermal deposition coating to function as a self-supporting substrate running at high speed through a continuous coating line. Such self-supporting materials may include metals, metal alloys, metal mixtures, metal blends and combinations thereof Non-limiting examples of suitable substrate materials for receiving the continuous thermal deposition coating include both coated and uncoated steel sheet and strip along with non-ferrous substrate materials such as aluminum, copper, brass, etc. and/or combinations thereof. Additional substrate materials may include metal/non-metal composites, laminates or blends such as for example metal matrix composites or metal/polymer laminates. Such suitable composites may include copper cladded steel sheet or ceramic powder reinforced stainless steels, etc. The preferred substrate materials 5 for use within the thermal deposition process of the present invention include steel substrates that are either hot-dip coated or electroplated with zinc, zinc-alloy, or zinc-aluminum alloy coatings comprising galvanized, Galvalume, galvanneal, and ZnNi EG® coated sheet steel products or the like, with Galvalume sheet steel products being most preferred.

In a continuous hot-dip coating line, as shown in FIGS. 3–4, the leading end of a new coil of substrate material 5 is spliced onto the trailing end of substrate material 5 running through the coating line. The splice is made prior to entry into the hot-dip bath to form a continuous self-supporting web that runs at high speed, about 180 m/min., through the hot-dip coating line. Similarly, at the exit end of the line, the trailing end of a finished coil of substrate is sheared from the leading end of a subsequent finished coil of substrate. The line is maintained at a substantially constant speed by entry end and exit end looping towers (not shown) that take-up or pay-out excess amounts of web substrate 5 during splicing and shearing operations that feed and remove coils from the continuous line. Operational speeds of a continuous hot-dip line in the present invention are dependent on the proper hot-dip coating of the substrate 5. The heat resident in the moving metal web from the hot-dip bath, in combination with the temperature regulating apparatus 31, ensures that the continuous moving metal web section 5*a* enters the coating solution 8 at an appropriate target temperature. Preferred web speeds for the present thermal deposition coating process invention may range from about 15 m/min. to about 1500 m/min., with more preferred line speeds of from about 60 m/min. to about 230 m/min., and most preferred line speeds of from about 120 m/min to about 180 m/min. It should be understood that although the disclosed embodiments show applying a hot-dip coating to both sides of the continuous web, existing state of the art apparatus for applying a hot-dip coating to only one side of the continuous moving web may be used without departing from the scope of this invention.

In the exemplary embodiment shown in FIG. 5, substrate 5 is below target temperature because the substrate material 5 is not heated in a processing step such as hot-dip coating, galvannealing or annealing immediately prior to applying the thermal deposition coating. Such cold substrate materials may include for example, electrogalvanized steel, aluminum, copper, brass, or the like. The surface of the cold substrate 5 is cleaned to remove imperfections, contaminants and/or other similar defects prior to entry into heat source 31. Cleaning includes any combination of means obvious to those skilled in the art to remove dirt, oil, oxides or other contaminants from the surface of substrate 5 that would interfere with the adhesion or uniform application of the thermal deposition coating. The first cleaned substrate segment 5 enters heat source 31 where it is heated to a selected target temperature with additional segments of substrate 5 being added in a manner that permits the heated moving unfinished metal web portion 5*a* to continuously proceed through the continuous bath application process that applies the thermal deposition coating to the surface of the heated substrate at the immersion plane 8*a*.

Referring to FIGS. 3–5, the cleaned moving metal web portion 5 enters the heat source 3 or 21, and/or temperature regulating apparatus 31, where the web portion is heated to a selected target temperature sufficient for thermal deposition of solids onto the surface of the moving metal web. The preheated web portion 5*a* is then immersed into the thermal deposition coating solution 8 at the immersion plane 8*a* where the temperature difference between the web portion and the thermal deposition coating solution is maximum. As additional segments of substrate 5 pass through heat source 3, 21, and/or temperature regulating apparatus 31, the substrate segments 5 are heated to the selected target temperature uniformly along the entire length and width of the heated web portion, i.e., each heated portion of the moving metal web 5*a* is heated to a temperature substantially equal to other heated portions 5*a* of the moving metal web. Heat sources 3 and 21 comprise heat energy resident in the hot-dip bath 4 or 22, and the temperature regulating apparatus 31 may include, but is not limited to induction, infrared, or convection furnaces 34, for heating or blowers 33 for cooling. The substrate temperature is monitored using sensors 32 immediately prior to immersion into the coating solution 8 with the output signal from the sensors being used in a feedback control loop to maintain a proper target temperature at the immersion plane 8*a* on the surface of the coating solution 8. Preferably the moving metal web portions 5*a* retain sufficient residual heat from the hot-dip bath 4 or 22 for thermal deposition of solids onto the surface of the moving metal web with the temperature regulating apparatus 31 providing a secondary heating/cooling source to maintain a constant and equal target temperature in successive web portions 5*a* being immersed into the thermal deposition solution 8. The output signal from sensors 32 is used to control either the heating units 34 or blowers 33 that cool the strip if the hot-dip bath elevates strip temperature above a selected target temperature for the thermal deposition process.

In the embodiment shown in FIG. 3, the moving metal web portion 5*a* is heated to the selected target temperature required for proper thermal deposition of a coating, and each heated moving metal web segment 5*a* fed through an entry bridle 35 located upstream from the coating solution contained in loop coater 7. It should be understood, however, that the entry bridle 35 may be placed before or after the temperature regulating apparatus 31 as shown in FIGS. 3–5. The entry bridle 35 properly positions and aligns the continuous moving metal web 5 for immersion into the coating solution 8. Entry bridle 35, in combination with an exit bridle 36, are used to maintain a constant looped length of heated moving metal web portion 5*a* in the immersion tank 9 of the loop coater 7. The bridles 35 and 36 also maintain continuous moving metal web tension in the rest of the line. After passing through the entry bridle 35, a set of seal rolls 37, or similar device, may be positioned to receive and further stabilize the continuous heated moving metal web 5*a* before entry into the coating solution 8. The seal rolls 37 minimize vibrations in the moving metal substrate portion 5*a* and fix the web in a proper orientation relative to the coating bath 8 to insure a uniform planar contact of the thermal deposition coating solution 8 with the substrate surfaces as the web portion 5*a* passes through immersion plane 8*a*.

The thermal deposition coating process is continuous as heated moving metal web segments 5*a* continuously pass through immersion plane 8*a* into the thermal deposition coating solution 8. The continuing movement of additional substrate segments 5*a* through immersion plane 8*a* into the coating solution 8 occurs without interruption of the continuous thermal deposition coating process. Because each web portion 5*a* is uniformly heated to the selected target temperature, the application of the coating solution 8 is constant along the entire length of the moving heated metal web 5*a*. The moving metal web segments 5*a* are heated sufficiently to obtain and maintain a target temperature that is sufficient to deposit the particular coating from the coating solution 8 thereto for a given substrate material 5 at a selected line speed as the moving heated metal web portions 5*a* contact the coating solution 8 at the immersion plane 8*a*.

Figure 8:
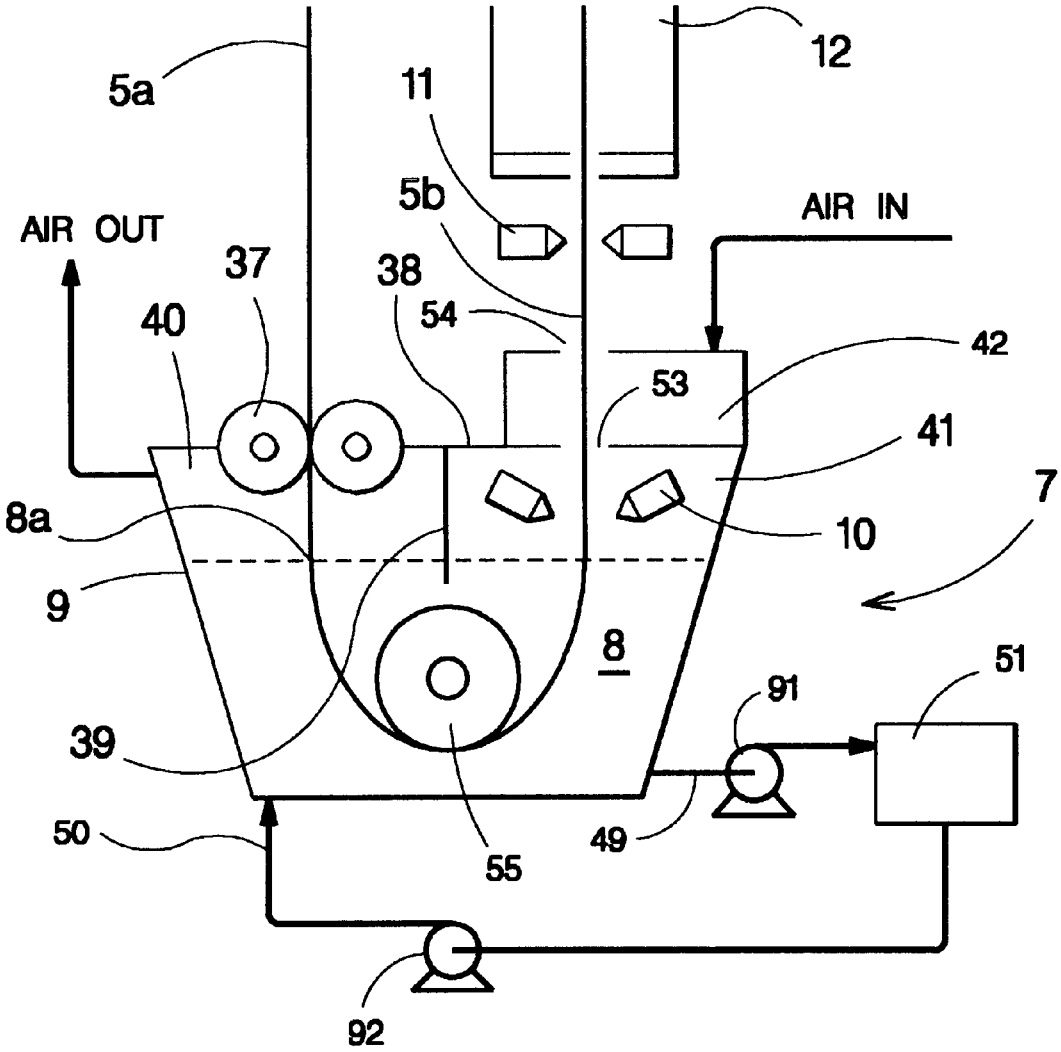
FIG. 8 shows a modification of the process shown in FIG. 5 having a sink roll component in the coating solution bath.

As shown in FIGS. 3–5, the continuous heated moving metal web portion 5*a* enters an immersion tank 9 that contains the thermal deposition coating solution 8. Tank 9 includes a cover 38 and baffle 39 arrangement that divides tank 9 into an entry side 40, an exit side 41, and an air lock chamber 42. Baffle 39 extends below the free surface 8*a* of the solution bath 8, and it isolates incoming continuous moving heated web portions 5*a* from the air knives 10 located in exit side 41. Air knives 10 wipe excess coating solution 8 from the outgoing continuous moving web portions 5*b*, and cause the excess coating solution to fall back into the immersion tank 9 before the web portions 5*b* exit the immersion tank. A continuous feed of clean air maintains the air lock chamber 42 at a pressure above ambient atmospheric pressure while the entry side 40 and the exit side 41 of the tank are vented to a pressure below ambient atmospheric pressure. The resultant pressure gradient prevents a release of process vapors into the atmosphere, and directs process vapors to environmental control equipment (not shown) at a location remote from the work environment. Additionally, seal rolls 37, or other suitable device, may be positioned to reduce the escape of process vapors from the entrance side 40 of the immersion tank. Therefore, air lock 42 may be modified to service only the exit side 41 of immersion tank 9, as shown in FIG. 8, without departing from the scope of this invention. Additionally, although the disclosure shows a continuous feed of air being used to maintain the air lock chamber at pressure, it should be understood that any suitable gas feed, for example an inert gas feed, may be used to maintain air lock chamber pressure without departing from the scope of this invention.

Upon entry into the immersion plane 8*a*, within tank 9, the continuous heated metal web portions 5*a* retain solids from the coating solution 8. The solids immediately bond to the heated substrate surfaces through thermal deposition along the initial line of contact, or line of thermal deposition, at immersion plane 8*a*. The line of contact, or line of thermal deposition, extends across the entire width of the heated web surfaces transverse (orthogonal) to the direction of web travel. This provides a continuous straight line of contact that is essential to an even coating deposition because it provides a uniform transfer of heat energy along the initial line of contact from the moving web to the coating solution. This uniform transfer of heat energy along the line of thermal deposition enables a uniform deposition of solids from the coating solution to the line of thermal deposition and thereby creates a smooth, even coating film across the width of the moving web.

Entry baffle 39 isolates the incoming heated web portions 5*a* from the outgoing coated web portions 5*b* exiting the thermal deposition coating solution 8. Baffle 39 prevents the air knives 10 from splattering mist or droplets of excess coating solution 8 onto the incoming heated web portions 5*a* before portions 5*a* are immersed in the thermal deposition solution 8. This shielding by entry baffle 39 maintains target temperature in the web portions 5*a* that could be reduced if air knife 10 over spray spatters the incoming heated web portions. Such spattering will reduce surface temperature locally in the heated web portions and adversely affect the quality of the thermal deposition coating applied or bonded to the web portions 5*b*. Shielding of the heated moving metal web 5*a* is accomplished by extending the entry baffle 39 below the free surface 8*a* of the thermal deposition coating solution 8. In the best mode embodiment, however, the depth of the entry baffle 39 into the coating solution 8 is preferably sufficiently shallow to permit adequate re-circulation or mixing of the coating solution within immersion tank 9. Such mixing is beneficial to replenishing solids that are depleted from the solution during the thermal deposition coating process and minimize any temperature gradients that might occur in the thermal deposition solution 8 due to stagnant areas in the immersion tank 9. Proper chemical proportions are determined and maintained in the coating solution 8 by those skilled in the art. The depleted solution 8 is discharged at the exit side 41 of tank 9 through a discharge line 49 and pump 91 to recycling apparatus 48 that provides a constant flow of regenerated coating solution to the immersion tank 9 by pump 92 through feed hie 50. The continuously regenerated and recycled solution 8, maintains a suitable percentage of solids by weight in the coating solution 8 as determined to achieve a proper thermal deposition coating on the heated web portions 5*a* entering the immersion plane 8*a* of the solution. As the continuous heated moving metal web 5*a* passes through the coating solution 8, solids are depleted from the coating solution 8 by thermal deposition onto the surfaces of continuous moving metal web portions 5*a* to form the coated continuous moving metal web portions 5*b*. The latent heat in the moving metal web 5*a* vaporizes the liquid components of the coating solution 8. The recycling apparatus 48 may add solids and liquids into the coating solution 8 within the immersion tank 7 and/or replace the depleted coating solution 8, continuously or at timed intervals. Either method replenishes solids and liquids in the coating solution 8 that have been removed during the continuous thermal deposition coating process to maintain an acceptable percentage of solids by weight and chemistry of the coating solution 8. Replenishing and recycling of coating solution into the immersion tank 9 must be done in a fashion that maintains the immersion plane 8*a* above the bottom of baffle 39. Additionally, the thermal deposition coating process transfers heat energy from the heated web portions 5*a* into the coating solution 8. Such continuous heat transfer elevates coating solution 8 temperature, and if uncontrolled, the increased solution temperature may reach a level that is detrimental to applying high quality thermal deposition coating on the web surfaces. Therefore, the recycling apparatus 48 may also include a heat exchanger to maintain the coating solution 8 within a selected temperature range during the thermal deposition coating process.

Various coating solution compositions are suitable for use with the present thermal deposition coating process invention. Such coating solutions generally include a volatile and a non-volatile component. The non-volatile component includes solid materials, for example organic and inorganic compounds, mixtures of organic and inorganic materials, polymers, polymer emulsions, suspensions and dispersions, or mixtures thereof, or the like so long as they are capable of being deposited onto the heated surface of substrate 5*a* at a specific temperature or temperature range. The volatile component provides a carrier or vehicle for the non-volatile (solid) components in the composition, and it may be water, organic solutions, solvents, solvent mixtures and/or water-solvent mixtures, in forms such as emulsions or dispersions. The volatile component must be capable of uniformly dispersing, dissolving, suspending and/or emulsifying the non-volatile solid material. Thermal deposition of the non-volatile solid component provides uniform and even application of the solid material onto the heated surfaces of the substrate web portions 5*a* as they pass through the immersion plane 8*a* of the bath application shown in FIGS. 3–5, and 8–9 or through the solution curtain 62 of the curtain application shown in FIGS. 6–7. Preferably the coating solution 8 contains from about 0.1–60% by weight non-volatile components, with more preferred amounts in the range of from about 0.515–40% by weight solids, and a most preferred range of from about 1–20% by weight solids. Preferred volatile amounts range from about 40–99.9% by weight, more preferably from about 60–99.5% by weight, and most preferably from about 80–99.9% by weight. Amounts and content of the volatile and non-volatile components of the coating solution 8 for a particular purpose are determinable by those skilled in the art. The coating solutions 8 may coat the substrate for final use, or for preparation of additional coatings that provide improved corrosion performance, formability, adhesion and/or aesthetic appearance, and the like. The coating chemistries and resins are designed and selected specifically for thermal deposition with the processing variables chosen for specific coating chemistries and product applications, and the proper selection of the coating solution 8 determinable by those skilled in the art. Coating thickness varies as a factor of the specific heat capacity of the substrate 5, entry temperature of the continuous heated moving web portions 5*a* into the coating solution 8, thickness of the substrate 5, and/or the percentage amount of solids within the coating solution 8, with specific coating thickness being obtainable with variations of these factors. Selection of the proper coating solution and criteria for obtaining specific coating thickness for a given application is determinable by those skilled in the art.

Particularly useful resins for coating solutions 8 useful for the present invention include, for example, but are not limited to, water-reducible alkyl resins, acrylic polymers, acrylic colloidal dispersions, acrylic resins, acrylic emulsions, acrylic colloidal solutions, thermoplastic urethanes, multi-functional carbodiimides, water-dispersible polyurethane lacquers, melamine-formaldehyde resins, styrene-acrylic polymers, polyethylene, polypropylene, or polyethylene/paraffinic wax emulsions, polyvinylidene chloride copolymer emulsions, ethylene-acrylic copolymer emulsions, and mixtures, blends and combinations thereof Additional useful coating solutions are disclosed in U.S. Pat. Nos. 5,283,280 to Whyte et al. and 4,690,837 to Doroszkowski and Skinner, the disclosure of which is herein incorporated by reference.

Proper solid content of the coating solution 8 within immersion tank 9 is regulated through the use of the recycling apparatus 48 containing an immersion tank reservoir 51. As herein described, the immersion tank reservoir 51 continually replenishes the solids and/or solvent that has been removed from the immersion tank 9 through the coating process. The coating solution 8 within the immersion tank reservoir 9 is maintained at a suitable temperature for thermal deposition of the solids onto the substrate. Proper temperature of the coating solution is maintained with heat exchanger 52 immersed in the coating solution, heat exchanger apparatus housed within reservoir 51, and/or other temperature control apparatus. The coating solution contained within the immersion tank 9 is continuously stirred to ensure mixing with the incoming regenerated solution from feed line 50. Such mixing provides a more uniform temperature and concentration in the coating solution 8. In addition, concentrated make-up solution, water, or other solvents may be added to immersion tank 9 as necessary to maintain a stable concentration in the thermal deposition coating solution 8.

Substrate 5 may be heated to any temperature suitable for thermal deposition of a particular coating, with the proper temperature of the substrate 5 being determinable by those skilled in the art. Proper contact temperature along the line of thermal deposition 8*a* allows the coating to deposit uniformly onto the substrate surface. Temperature variations along the line of thermal deposition or immersion plane 8*a* interfere with the proper, uniform application of thermally deposited coatings onto a substrate surface. Accordingly, each heated moving metal web section 5*a* must retain an amount of heat within a predetermined temperature range. Unregulated heating at the heat source 3, 21, and/or 31, or intermittent heat sinks, such as spattering, contact of the moving metal web with foreign bodies, i.e., supports, and other like heat absorbing occurrences between the heat source and the line of thermal deposition 8*a*, interfere with the efficient continuous thermal deposition coating process that produces a uniformly thick, smooth, and even coating along the continuous surface of the web. Preferably, substrate 5 is heated to a temperature ranging from about 100° C.–1370° C., a preferred temperature range of from about 150° C.–1200° C., a more preferred temperature range of from about 150° C.–650° C., and a most preferred temperature range of from about 175° C.–370° C.

As the coated continuous moving metal web 5*b* exits the coating solution 8, air knives 10 within the immersion tank 9 deliver a flow of forced air across the coated surfaces to remove excess coating solution and return it to the immersion tank 9. The air knives 10 are arranged to present a uniform pressurized air flow across the width and along the length of the coated continuous moving metal web 5*b*. For example, in removing excess coating solution 8 from the steel substrate 5*b*, a plurality of air knives 10 are spaced apart across the width of the coated substrate 5*b* with each air knife delivering approximately 300 cfm of air, at ambient temperature, to the substrate surface. Orientation of each air knife 10 to the surface plane of substrate portions 5*b* are variable, with the proper angle being determinable by those skilled in the art. Typical knife to substrate angular relationship is between about 10° and 90° from parallel with a more preferred angular relationship being about 20° and 45° from the parallel, and the most preferred angle being between about 30° and 40° from the parallel.

Baffle 39 and cover 38 contain the operation of the air knives 10 within exit side 41 of tank 9, retain the excess coating solution 8 within the immersion tank 9, and prevent the air wipe from spattering the incoming web portions 5*a* on the entrance side 40 of the tank. The covered tank arrangement prevents environmental contamination of the coating solution 8 within the immersion tank 9. A set of external air nozzles 11 and 13 are positioned on the exit side of air lock 42 to stabilize the coated continuous moving metal web 5*b*. Air lock 42 comprises a housing attached to and extending upward from immersion tank 9. The air lock includes a discharge slot 53 vertically aligned with a discharge slot 54 in cover 38 through which the coated continuous moving metal web 5*b* exits the immersion tank 9 along a substantially vertical pass-line. The air lock 42 in combination with the covered immersion tank form a multi-tiered structure through which the coated continuous moving metal web 5*b* exits. The aligned openings provided by discharge slots 53 and 54 are sufficiently close to the exiting coated continuous moving metal web 5*b* to minimize entrance of contaminants into the immersion tank 9 and exit of process sprays, mists and gases of the coating solution 8 into the work environment. The size and shape of the air lock and discharge slot openings may be fixed for a given web width and thickness, web temperature, web speed, air knife velocity, and other operational parameters, with the determination of the size and shape of the air lock 42 and openings 53 and 54 determinable by those skilled in the art.

As the coated continuous moving metal web 5*b* progresses past the discharge pass-line outside air lock 42 and the set of air nozzles 11, it continues through a curing oven 12 where the thermal deposition coating on the web 5*b* is dried and cured. Drying and curing may be accomplished by convection, infrared and/or induction heat means or by a combination of these means. The required curing and/or drying time and temperature are dependent on coating, coating solution, and substrate properties, or the like, as determined by those skilled in the art. In thermal deposition coating solutions having inorganic solid compositions, and no polymer component, the curing oven 12 may be used for drying, or may be eliminated if drying can be achieved by the blower 15.

On exiting the curing oven 12 additional air nozzles 13 are used to stabilize the continuous moving metal web 5*b*. Water mist jets 14 and/or blowers 15 are used to cool the coated continuous moving metal web 5*b* to prepare it for contact with the turn roll 16 and the exit bridle 36. In the case of cooling by water mist jets 14, the coated continuous moving metal web 5*b* is further cooled and/or dried using the blowers 15. The flow rates of the water mist jets 14 are metered to avoid excessive water run down. The blowers 15 can be used alone or in conjunction with the water mist jets to cool or dry the continuous moving metal web 5*b* depending on the amount of cooling or drying required for the specific thermal coating applied. The exit bridle 36 provides take-up of the coated continuous moving metal web 5*b* without disruptions in the continuous bath application process of the coating solution 8 and is synchronized with the entry bridle 35 to maintain a constant length of strip between entry bridle 35 and exit bridle 36.

FIG. 8 shows an alternate embodiment for carrying out the steps of the thermal deposition coating process having additional means for stabilizing the looped web pass-line against vibration or oscillation as it passes through the thermal deposition coating solution 8 contained in immersion tank 9. Sink roll 55, within the bath, assists with positioning and stabilizing the heated moving metal web portions 5*a* entering the immersion tank 9. Use of such sink rolls 55 preferably occurs when a high quality thermal deposition coating is only required on one side of the finished web product and/or the coating is not substantially disturbed by roll contact prior to being dried and/or cured.

Figure 10:
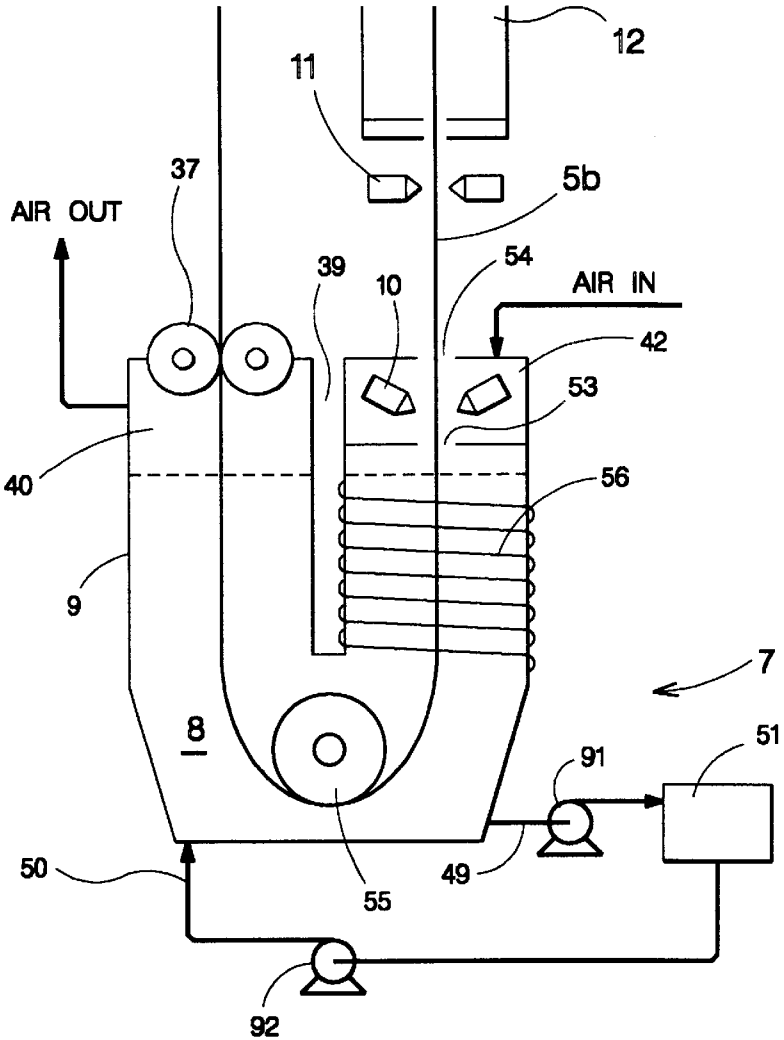
FIG. 10 shows an alternate embodiment for thermal deposition of the coating by inductively heating an immersed portion of the moving substrate.
Figure 9:
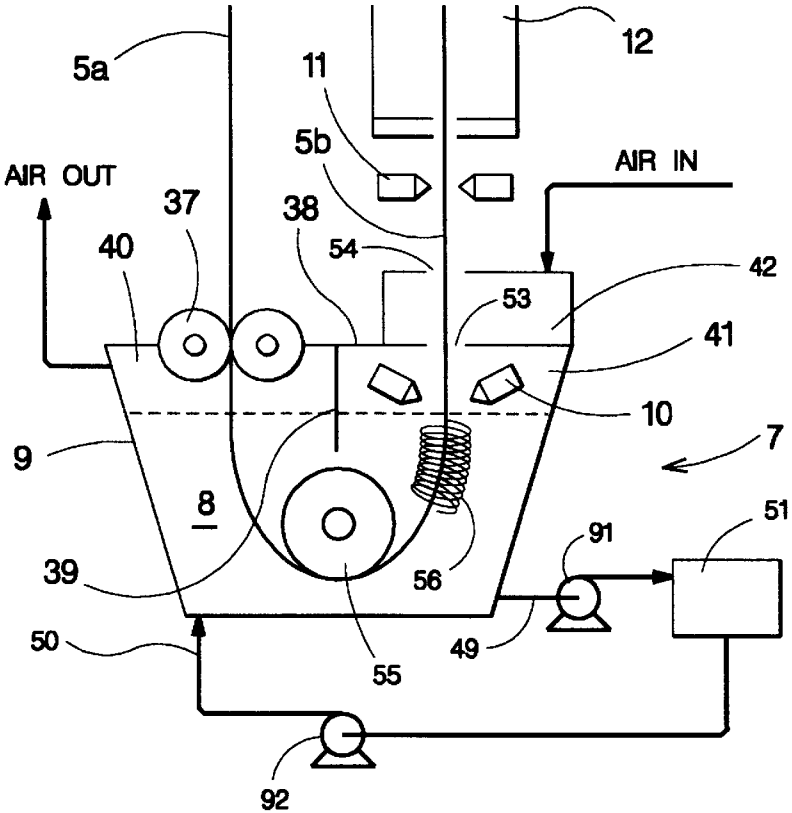
FIG. 9 shows a modification of the process shown in FIG. 5 having additional components for thermal deposition of the coating by inductively heating an immersed portion of the moving substrate.

FIGS. 9 and 10 show further alternate embodiments for carrying out the steps of the thermal deposition coating process having non-contact induction heating devices 56 for in situ heating of the moving metal web. In FIG. 9, an internal induction-heating device 56 is shown immersed within the thermal deposition coating solution 8. FIG. 10 shows a non-contact induction heating device 56 external to the bath and positioned to raise the immersed web portion to target temperature. The induction heating devices 56 are used to achieve coating deposition and control film thickness onto a moving metal web 5 after the web substrate has been immersed in the coating solution 8. In such instances, a sink roll 55 may be used to control strip tension and position within the coating bath 8 because the induction heating device 56 can be positioned so that no coating is applied to the substrate 5*a* until the upleg side of the sink roll. Such induction-heating devices 56 are functional for conductive substrates that constitute the moving web 5. Induction heating devices 56 could be used with or without additional heat sources external to the coating solution immersion tank 9.

Figures 6, 7:
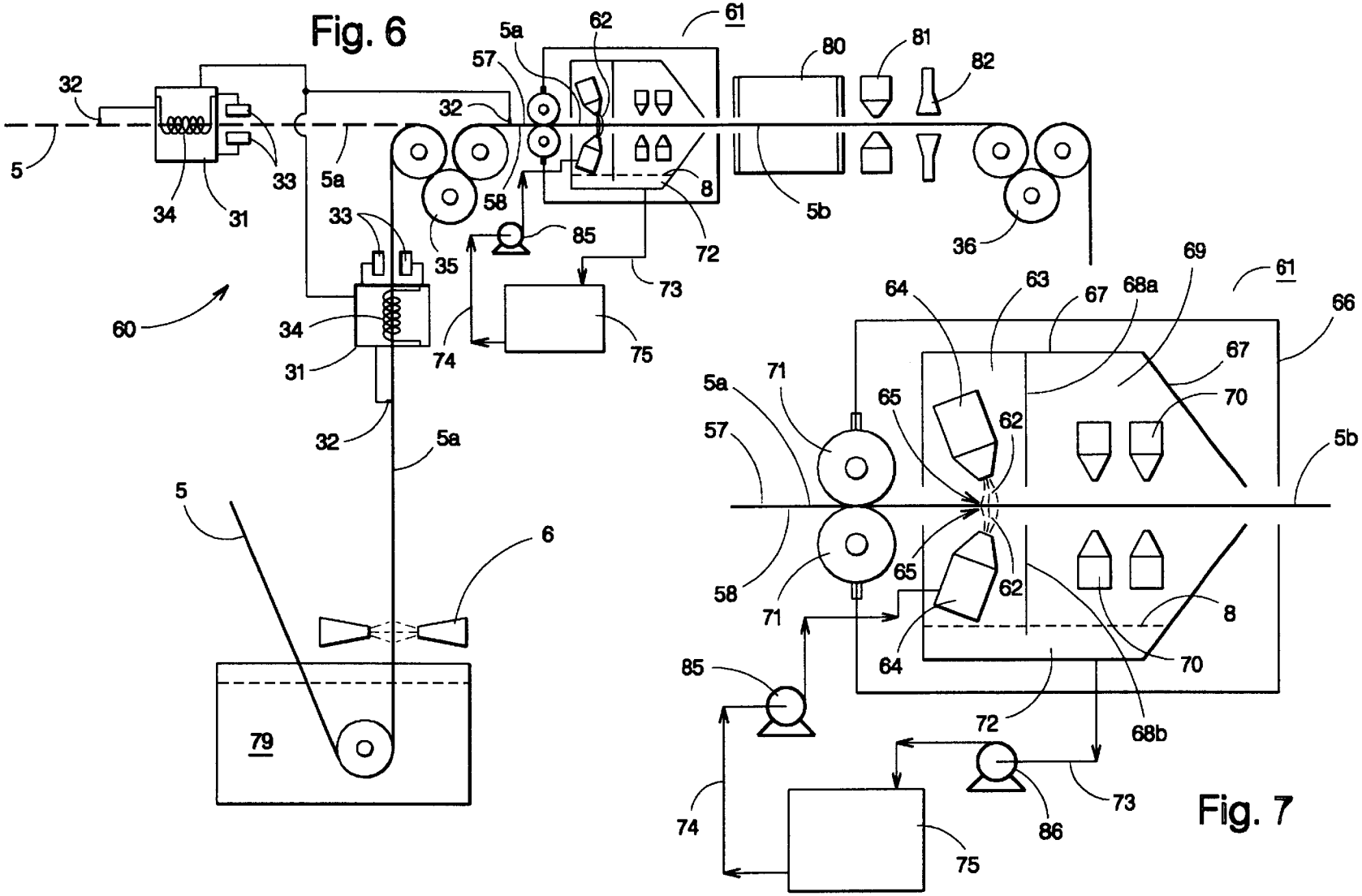
FIG. 6 is a schematic view of the present invention showing an exemplary continuous flow applicator for applying a thermal deposition coating to a moving substrate.
FIG. 7 shows an enlarged view of a continuous flow applicator similar to FIG. 6.

In a second preferred embodiment for carrying out the steps of the thermal deposition coating process, shown in FIG. 6, the thermal deposition coating solution is applied to the heated moving metal web portions 5*a* using a continuous flow coater assembly 61 to create a continuous curtain application process 60. The coater assembly 61, referred to as a continuous flow coater, provides an uninterrupted curtain or sheath 62 of thermal deposition coating solution 8 against the moving heated metal web portions 5*a* at predetermined specific flow rate. It should be understood, however, that solution flow rate is only important to the extent that it is maintained above a minimum value that insures a sufficient amount of solution is applied to the web surface on which the thermal deposition coating is being applied. The continuous flow of thermal deposition coating solution 8 is generally applied at the same line of contact on both surfaces of the heated moving metal web. The lines of contact of the coating solution with the first surface 57 and the second surface 58 may be separated spatially, however, to achieve differentiated coating thickness on opposite sides of the moving metal web.

Referring to FIGS. 6 and 7, the continuous flow coater assembly 61 comprises an outside housing 66, an inside housing 67, and a baffle 68 that divides the inside housing 67 into an application chamber 63 that houses the aligned continuous flow applicators 64, and a discharge chamber 69 that houses air knives 70. The moving metal web 5 passes through a heat source, for example the hot-dip zinc galvanizing bath shown at 79, or the temperature regulating apparatus shown at 31, to acquire sufficient thermal energy, i.e., temperature for thermal deposition of a particular thermal deposition coating. The heated moving metal web 5*a* is fed through bridle 35, seal rolls 71, and into the application chamber 63 containing the continuous flow applicators 64. As the heated moving metal web 5*a* passes into the coater assembly 61 through the outer housing 66, the seal rolls 71 stabilize the heated metal web 5*a* and provide a seal means that reduces emissions from the feed side of the outer housing. The seal rolls 71 align the continuous web with the coater assembly 61 and minimize any release of process gases from the coater assembly 61 into the work environment. In a manner similar to the embodiments described in FIGS. 3–5, pressure within the outer housing portion 66 of the continuous flow coater is maintained above ambient atmospheric pressure by a continuous feed of clean air into chamber 66. Pressure within the inner housing 67 is maintained below ambient atmospheric pressure. The resultant pressure gradient drives coating process vapors toward environmental control equipment located remote from the work environment. As in other embodiments, web tension is maintained by the bridle rolls 35 and 36 located at the entrance and exit sides of the coating apparatus. The catenary shape of the unsupported moving metal web 5*a* and 5*b* between the seal rolls 71 and exit bridal rolls 36 is determined by the strip tension that is controlled by the bridal rolls 35 and 36 in a manner obvious to those skilled in the art. The temperature regulating apparatus 31 can be located either before or after the entry bridal rolls 35, and may be used in conjunction with prior processing, such as hot-dip coating, galvannealing or annealing.

As more clearly shown in the enlarged view of FIG. 7, the aligned continuous flow applicators 64 apply a continuous curtain flow 62 of thermal deposition coating solution to opposite sides of the heated web portions 5*a*. The continuous curtain flow 62 contacts the heated moving metal web 5*a* on the web surfaces 57 and 58. The curtain flow forms a line of contact 65 with the web surfaces 57 and 58 that is perpendicular to the direction of web travel and is at the same relative position on the opposite surfaces 57 and 58 of the heated moving metal web 5*a*. The continuous curtain flow is a non-spray application of the coating solution 8 that does not spatter the web surfaces 57 and 58 upstream of the line of contact 65 where the solution falls onto the surface of the heated continuous moving web 5*a*. As the heated moving metal web 5*a* progresses past the continuous flow applicators 64, a curtain or sheath of coating solution 62 is forced against each side or opposite surfaces 57 and 58 of the heated moving metal web. On contact with the heated surfaces, solids contained in the coating solution are bonded to the web surfaces 57 and 58 by thermal deposition. To obtain a uniform coating thickness on sides 57 and 58, the continuous flow applicators 64 are aligned opposite each other, are fed with the same coating solution, and provide coating solution at a rate that is greater than some minimum value determined by one skilled in the art. A pump 85 is used to maintain a proper pressure head for impinging both surfaces of the horizontal heated moving metal web 5*a* with the curtain of coating solution 62 forced to produce the desired line of contact 65. The coating solution is pumped into a plenum that minimizes pressure gradients and produces a uniform flow rate through the continuous flow applicator nozzles. In the preferred embodiment, each continuous flow applicator nozzle 64 includes a single elongated rectangular aperture or slot for applying the continuous flow of thermal deposition coating solution 62 onto opposite surfaces 57 and 58 of the heated web 5*a*. It should be understood, however, that nozzles 64 may comprise other aperture arrangements without departing from the scope of this invention. For example, the nozzles may include a plurality of rectangular, square, or round apertures spaced apart along the length of the continuous flow applicators 64 that apply the coating solution sheath 62. Similarly, a variety of nozzle or nozzle array orientations may be utilized without departure from the scope of this invention. The length of the preferred rectangular nozzle slot is proportional to, but larger than the width of the heated moving metal web 5*a*. For continuous sheet or strip substrates of the type shown in the attached drawing figures, a pair of opposed nozzles 64 are used to sheath the first sheet surface 57 and second sheet surface 58 with thermal deposition coating solution. The continuous flow applicator nozzles 64 orient the falling curtain toward the downstream direction of sheet travel to minimize any coating solution splashing on the upstream side of the line of solution contact 65. The upper and lower slots are aligned parallel to each other and perpendicular to the travel direction of the heated moving metal web 5*a*. The continuous flow applicator nozzles 64 are adjustable so that both solution sheaths can be directed to impinge the heated moving metal web 5*a* at the same transverse position, the line of solution contact 65. Alignment of the upper and lower coating solution sheaths results in symmetric thermal gradients and an even coating distribution on the first surface 57 and second surface 58 of the heated moving metal web 5*a*. The pressure head and nozzle geometry are used to control the flow rate of the thermal deposition coating solution. If differential side-to-side coating thickness is desired, the continuous flow applicators may be spatially separated for apply coating solution to one side 57 and a second side 58 at different positions relative to the direction of travel of the strip.

After the moving metal web progresses through the application chamber 63, the now coated continuous moving metal web 5*b* passes through an opening in baffle 68 and is air wiped within the discharge chamber 69 by a flow of pressurized air from one or more sets of air knives 70 positioned on opposite sides 57 and 58 of the coated continuous moving metal web 5*b*. The series of air knives 70 and/or transvectors are used to remove excess coating solution from the coated continuous moving metal web 5*b*. The air knives 70 are separated sufficiently from the continuous flow applicator nozzles 64 to minimize airflow interference with the solution sheath 62, such as by providing sufficient separation distance and/or baffling, i.e., baffle 68. The air knives 70 force excess coating solution 8 off the surfaces of the coated continuous moving metal web 5*b*, and into the collection pan 72 within the coater assembly 61. The excess thermal deposition coating solution 8 is captured in the collection pan 72 and is continuously pumped through discharge line 73 to a reservoir 75 with a pump 86. A heat exchanger is used to maintain a constant coating solution temperature in reservoir 75. Concentrated make up solution, water or other solvents are continuously or periodically added to the reservoir or at some point in the coating solution recirculation system to maintain a stable thermal deposition coating solution concentration, with the coating solution 8 in the reservoir 75 continuously mixed to ensure an even distribution of the contents and temperature therein. The replenished thermal deposition coating solution 8 is discharged from reservoir 75 through line 74 to pump 85 where it is recycled back into the thermal deposition coating process.

As herein described above for other embodiments of the present invention, baffle 68 isolates incoming heated web portions 5*a* from outgoing coated web portions 5*b*. Baffle 68 prevents the air knives 70 from splattering mist or droplets of excess coating solution 8 onto the incoming heated web portions 5*a* before the heated portions are flooded in the falling curtain 62 of thermal deposition solution 8 provided by the continuous flow applicator 64. Baffle 68 also minimizes interference of the coating solution curtain 62 from the airflow associated with the air knives 70. The shielding provided by baffle 68 maintains target temperature in the web portions 5*a* that may be reduced if the air knife 70 causes over spray of solution 8 onto incoming heated web portions 5*a*. Such spattering will spot reduce surface temperature of the heated web 5*a* and adversely effect coating quality due to an uneven temperature along the web surface prior to the proper line of solution contact 65. Shielding of the heated moving metal web 5*a* is accomplished by extending the baffle 68*a* in a downward direction from a top wall portion of inner housing 67 to a location above the upper surface 57 of the heated moving metal web 5 and by extending the baffle 68*b* up from a bottom wall portion of inner housing 67 to a location just below the lower surface 58 of the moving metal web 5. The portion of baffle 68*b* adjacent to the bottom portion of the inner housing should be perforated to allow drainage of collected coating solution from both sides of collection pan 72. Proper design and orientation of baffles 68 and housing 67 eliminates splashing of coating solution onto strip.

The coated continuous moving metal web 5*b* then exits the coating apparatus 61, and progresses into a curing or drying oven 80, if curing or drying is desired. Drying and curing may be accomplished by heating the coated continuous moving metal web 5*b* by convection, infrared, induction and/or a combination of these means. The required curing or drying time and temperature are dependent on the properties of the coating, the coating solution 8, and the substrate material 5. After curing and/or drying, the metal web 5*b* may be cooled by water mist jets 81 and/or air blowers 82 to prepare it for contact with the exit bridle 36. In the case of cooling with water mist jets 81, the coated continuous moving metal web 5*b* is dried prior to downstream shearing, coiling, further processing, and/or shipping. In a similar manner as previously described for the immersed loop coater 7 embodiments shown in FIGS. 3–5, the curing, drying and cooling stages may be modified or eliminated for particular processing needs with their incorporation or elimination being determinable by those skilled in the art.

Thermal deposition coating solution temperature, substrate temperature, substrate line speed, and other such processing criteria for the continuous curtain application process 60 remain substantially similar to the immersed loop application process 7 herein described above with variations determinable by those skilled in the art. The flow of the coating solution 8 from the continuous flow applicators may comprise any sufficient flow rate for the proper coating of the heated moving metal web 5*b* as it moves between the opposed continuous flow applicator nozzles 64. For example, when used to coat a Galvalume sheet the coating solution 8 preferably is delivered at a flow rate of from about 100 milliliters to about 10 liters of coating solution per square meter of web surface area moving through the falling curtain of coating solution 62. Excess coating solution 8 falls from the moving web 5*b* into the collection pan 72 located within the coater assembly 61. As heretofore disclosed, the contents of the collection pan are drained or pumped into reservoir 75 by pump 86. The coating solution is periodically or continuously monitored and replenished with solids and/or solvent at some point in the recirculation system comprising the reservoir 75, plumbing 73 and 74, and pumps 85 and 86. Additionally a heat exchanger may be placed in the recirculation system to maintain proper coating solution temperature. The recirculation system provides continuous flow of recycled/replenished thermal deposition coating solution to applicators 64.

In either the bath 7 or curtain 60 application of the coating solution 8 onto the moving metal web 5, as the heated moving metal web 5*a* contacts the thermal deposition coating solution 8, the heat energy contained in the heated moving metal web 5*a* causes the applied coating solution to form a thermally deposited coating onto the continuous moving metal web 5*b*. The thickness of the applied coating varies with temperature and heat capacity of the substrate 5, and the solids content of the coating solution. Excess coating solution 8 that is not thermally deposited onto the substrate 5*a* is returned to recirculation tanks 51 or 75. The potential for coating defects in the web product made by the continuous bath or curtain application processes of the present invention is much lower than with other thermal deposition coating process, for example, batch processes or continuous spray application processes. The web product may comprise intermediate articles including primed galvanized sheet steel that is finish coated on a coil paint line and used as an exterior wall component, Galvalume sheet steel product with clear organic film that is roll formed into roof panels that receive no further organic coatings, and a primed galvanized steel product that is roll formed and fabricated into window or door frames that are finish painted after installation.

In operation, a web product being primed by thermal deposition includes the steps of heating at least a portion of a continuously moving unprimed web to a target temperature sufficient to deposit a priming composition thereto and applying a priming solution thereto in a manner that allows thermal deposition of the primer. Each portion of the moving metal web is heated at a substantially equal amount as other portions of the moving metal web that have passed through the heating component. This is accomplished by having a controlled temperature within the heating component that delivers a fixed target temperature in the moving metal web exiting the heating component and entering the coating solution.

EXAMPLE 1

IMMERSED LOOP BATH APPLICATION—Primer deposition

A hot-dip coated sheet 1 m wide and 0.5 mm thick with a Galvalume coating weight of 150 g/m$^2$ total both sides moves continuously through the constant speed portion of the hot-dip coating line at a velocity of 180 m/min. The hot-dip coated cold rolled steel sheet exits the Galvalume hot-dip coating bath and is cooled to approximately 350° C. prior to contact with the turn around roll. The strip then horizontally enters a bridal roll and travels through a pinch roll directing the strip downward through stabilizer rolls and into the coating solution. The Galvalume strip temperature is about 315° C. when it enters the immersion tank at a line speed of 180 m/min. and is immersed within the coating solution for a contact time of 2 seconds. The aqueous coating solution is held at a constant temperature of about 24° C. by circulating the solution through a heat exchanger. Circulation also provides for continuous mixing of the coating solution in the immersion tank. The coating solution contains 15% solids by volume, comprising a thermosetting epoxy-ester resin, strontium chromate corrosion inhibitor, titanium dioxide pigment and fillers. Heat energy in the strip from the hot-dipping process causes the deposition of the paint coating from the coating solution. The wet, thermally deposited paint film is 12.7 microns thick on the Galvalume sheet and contains 50% solids by volume. The excess coating solution is blown off the Galvalume sheet by transvectors as it exits the coating solution bath.

Air nozzles are used to maintain the sheet position through the up-leg curing and cooling section of the coater. An induction furnace raises the thermally coated Galvalume sheet temperature to 260° C. The final dry film thickness of the organic coating is 6.4 microns. The thermally coated Galvalume sheet is cooled to between about 65° C. and 80° C. by spraying water onto the surface. Prior to the exit turn around roll and bridle roll, a hot air drier removes residual water.

The finished product is a Galvalume coil with a pigmented, chromate-containing epoxy-ester primer.

EXAMPLE 2

IMMERSED LOOP BATH APPLICATION—Clear Coat Deposition

The hot-dip coated sheet is 0.76 m wide and 1.2 mm thick and has a Galvalume coating weight of 150 g/m$^2$ total both sides. The strip moves continuously through the constant speed portion of the hot-dip coating line at a velocity of 90 m/min. The hot-dip coated cold rolled steel is approximately 65° C. near the exit end of the line. Near the exit end and within the constant speed portion of the line, the strip vertically enters an induction furnace that heats the strip to 290° C. The strip is turned to enter a bridal roll horizontally and then travels through a pinch roll directing the strip downward through the stabilizer rolls and into the coating solution. The Galvalume strip temperature is 260° C. when it enters the immersion tank at a line speed of 90 m/min., and each 6 m segment of strip is immersed within the coating solution for a contact time of 4 seconds.

The aqueous coating solution is held at a constant temperature of 24° C. by circulating the solution through a heat exchanger. Circulation also provides for continuous mixing of the coating solution in the immersion tank. The coating solution contains 1.5% solids by volume, comprising a thermoplastic acrylic resin, and adhesion promoters. Heat energy in the strip causes deposition of the paint coating from the solution. The wet, thermally deposited film is 2.5 microns thick on the Galvalume sheet and contains 45% solids by volume. The excess coating solution is blown off the Galvalume sheet by air knives as it exits the coating solution bath.

Air nozzles are used to maintain the sheet position through the up-leg curing and cooling section of the coater. An induction furnace raises the temperature of the thermally coated Galvalume sheet to 120° C. The final dry film thickness of the acrylic coating is 1.0 micron. The thermally coated Galvalume sheet is cooled to between about 50° C. and 65° C. by air blowers. After the exit turn around roll and bridle roll the material is coiled for shipment.

The finished product is a Galvalume coil with a clear acrylic coating.

EXAMPLE 3

CONTINUOUS CURTAIN APPLICATION—Primer deposition

The hot-dip coated sheet is 1.0 m wide and 0.5 mm thick and has a Galvalume coating weight of 150 g/m$^2$ total both sides. The strip moves continuously through the constant speed portion of the hot-dip coating line at a velocity of 180 m/min. The hot-dip coated cold rolled steel sheet exits the Galvalume bath and is cooled to approximately 350° C. prior to contact with the turn around roll. The strip then horizontally enters a bridal roll and travels through a driven stabilizer roll into the coater enclosure. The Galvalume strip temperature is about 315° C. when it enters the coater enclosure. The top and bottom slot nozzles 64 flood the heated strip with coating solution, and the slot nozzles are spaced about 4.5 m upstream from air knives 70 to provide a coating solution contact time of about 1.5 seconds.

The aqueous coating solution is held by means of a heat exchanger at a constant temperature of about 24° C. in the main reservoir. The coating solution contains 15% solids by volume, comprising a thermosetting epoxy-ester resin, strontium chromate corrosion inhibitor, titanium dioxide pigment and fillers. Heat energy in the strip causes the deposition of the paint coating from the solution. The wet, thermally deposited paint film is 12.7 microns thick on the Galvalume sheet and contains 50% solids by volume. Excess coating solution is blown off the Galvalume sheet by air knives and pumped from the recirculation tank back to the main reservoir. The recirculated solution is used to mix the main reservoir.

A horizontal induction furnace raises the Galvalume sheet temperature to between about 255° C. and 265° C. for 4 seconds. The final dry film thickness of the organic coating is 6.5 micron mil. The Galvalume sheet is cooled to between about 65° C. and 80° C. by water spray onto the surface and air blowers. A hot air drier removes any residual water after the exit bridle roll.

The finished product is a Galvalume coil with a pigmented, chromate containing epoxy-ester primer.

EXAMPLE 4

CONTINUOUS CURTAIN APPLICATION—Clear Coat Deposition

The hot-dip coated sheet is 0.76 m wide and 1.2 mm thick and has a Galvalume coating weight of 150 g/m$^2$ total both sides. The strip moves continuously through the constant speed portion of the hot-dip coating line at a velocity of 90 m/min. The hot-dip coated cold rolled steel is approximately 65° C. near the exit end of the line. Near the exit end and within the constant speed portion of the line, the strip travels horizontally through an induction furnace that raises the strip temperature to 290° C. The strip then horizontally enters a bridal roll and travels through a driven stabilizer roll into the coater enclosure. The Galvalume strip temperature is about 260° C. when it enters the coater enclosure. The top and bottom slot nozzles 64 flood the heated strip with coating solution, and the slot nozzles are spaced about 4.5 m upstream from air knives 70 to provide a coating solution contact time of about 3 seconds.

The aqueous coating solution is held by means of a heat exchanger at a constant temperature of 24° C. in the main reservoir. The coating solution contains 1.5% solids by volume, comprising a thermoplastic acrylic resin and adhesion promoters. Heat energy in the strip causes the deposition of the paint coating from the solution. The wet thermally deposited paint film is 2.5 microns thick on the Galvalume sheet and contains 45% solids by volume. Excess coating solution is blown off the Galvalume sheet by transvectors and pumped from the recirculation tank back to the main reservoir. The recirculated solution is used to mix the main reservoir.

A horizontal induction furnace raises the Galvalume sheet temperature to 120° C. The final dry film thickness of the organic coating is 1.0 micron. The Galvalume sheet is cooled to between about 50° C. and 65° C. by an air blower.

The finished product is a Galvalume coil with a clear acrylic coating.

The foregoing summary, description, examples and drawings of the present invention are not intended to be limiting, but are only exemplary of the inventive features which are defined in the claims.

We claim:

1. A process for applying a continuous thermal deposit coating on a moving metal web, comprising the steps of:

heating at least a portion of the moving metal web to a target temperature sufficient to thermally bond a coating onto a surface thereof;

applying a coating solution to said heated portion of the moving metal web along a continuous line of thermal deposition on at least one surface of the moving metal web, and bonding solids from the applied coating solution onto said heated portion of the moving metal web along said continuous line of thermal deposition, the bonded solids forming said continuous thermal deposit coating.

2. The process of claim 1, wherein a width of said line of thermal deposition is responsive to a transfer of heat energy from said heated portion of said moving metal web to said coating solution.

3. The process of claim 2, wherein the moving metal web is self-supported at the line of thermal deposition.

4. The process of claim 1, further comprising the step;

regulating the temperature of a coating solution in a reservoir, wherein the regulated coating solution temperature, maintains stability of the coating solution, and lowers incoming heated substrate temperature below a temperature necessary for thermal deposition.

5. The process of claim 1, wherein the moving metal web comprises a continuous web.

6. The process of claim 1, wherein the moving metal web comprises a substrate consisting of a metal or a metal alloy.

7. The process of claim 6, wherein the moving metal web comprises a metal selected from the group consisting of steel, aluminum, brass, and copper.

8. The process of claim 7, wherein the moving metal web comprises steel.

9. The process of claim 8, wherein the steel moving metal web further comprises a hot-dip coating selected from a group consisting of zinc, zinc alloys, aluminum alloys, aluminum, and combinations thereof.

10. The process of claim 9, wherein the hot-dip coating comprises a steel product selected from the group consisting of galvanized, galvanneal, aluminized, and a hot-dip coating comprising zinc and about 55% aluminum.

11. The process of claim 10, wherein the hot-dip coating comprises zinc and at least 55% aluminum.

12. The process of claim 8, wherein the steel moving metal web further comprises a galvanneal coating.

13. The process of claim 8, wherein the steel moving metal web comprises an electroplated coating.

14. The process of claim 1, wherein the coating solution comes into contact with the heated portion of the moving metal web along said line of thermal deposition that extends along opposite surfaces of the heated portion of the moving metal web.

15. The process of claim 14, wherein each heated portion of the moving metal web is heated at a substantially equal amount as other heated portions of the moving metal web.

16. The process of claim 1, further comprising means for removing excess coating solution from moving metal web portions that have a temperature where thermal deposition does not occur.

17. The process of claim 1, further comprising means for curing the coating applied on the moving metal web.

18. The process of claim 1, further comprising the step of drying the coating on the web.

19. The process of claim 1, further comprising the step of removing solvent from the coating on the web.

20. The process of claim 1, wherein the coating solution comprises a bath process.

21. The process of claim 20, further comprising means for stabilizing the moving metal web to prevent web vibration or web oscillation.

22. The process of claim 21, wherein the means for stabilizing the moving metal web comprises a sink roll within the bath process.

23. The process of claim 21, wherein the means for stabilizing the moving metal web comprises air nozzles for stabilizing the moving metal web upon exit from the coating solution bath.

24. The process of claim 1, wherein the coating solution is applied through continuous flow applicators.

25. The process of claim 24, wherein the continuous flow applicators provide a flow of coating solution against a first and second surface of the moving metal web.

26. The process of claim 25, wherein a first continuous flow applicator distributes coating solution against a first line of thermal deposition with the moving metal web and a second flow applicator distributes coating solution against a second line of thermal deposition with the moving metal web.

27. The process of claim 24, wherein at least one continuous flow applicator provides a flow of coating solution against a side of the moving metal web.

28. The process of claim 24, wherein the continuous flow applicators provide a coating solution flow of between about 100 milliliters to about 10 liters of coating solution per square meter surface area of the moving metal web.

29. The process of claim 1, wherein said metal web portion is heated to target temperature before application of said coating solution.

30. The process of claim 1 wherein said metal web portion is heated to target temperature during application of said coating solution.

31. The process of claim 29 or claim 28 wherein target temperature is greater than 100° C.

32. The process of claim 31 wherein target temperature is between about 150° C. and about 650° C.

33. The process of claim 31 wherein target temperature is between about 175° C. and about 370° C.

34. The process of claim 31 wherein said metal web portion heated to target temperature is moving at a speed of between about 15 m/min. to about 1500 m/min.

35. The process of claim 34 wherein said metal web portion is moving at a speed of between about 60 m/min. to about 230 m/min.

36. The process of claim 34 wherein said metal web portion is moving at a speed of between about 120 m/min. to about 180 m/min.

37. The process of claim 34 wherein the solid content of the coating solution applied to the heated portion is between about 0.1% to about 60% by weight solids.

38. The process of claim 37 wherein said coating deposited on said heated portion is between about 0.5 microns to about 75 microns thick.

39. The process of claim 4, wherein the coating solution is recycled and the temperature of said recycled coating solution is controlled by circulating the recycled coating solution through a heat exchanger.

40. The process of claim 39, wherein said heat exchanger is placed outside of said reservoir in a recycling apparatus and said coating solution is recycled to said coating solution reservoir.

41. The process of claim 39 wherein the temperature of said recycled coating solution is controlled by cooling said recycled coating solution.

42. The process of claim 39, wherein said coating solution is cooled by said heat exchanger.

43. The process of claim 31 wherein target temperature is between about 250° C. and about 650° C.

44. The process of claim 31 wherein target temperature is between about 250° C. and about 370° C.

45. A process for applying a continuous coating on a moving metal substrate, comprising the steps of:

heating at least a portion of the moving metal substrate to a target temperature sufficient to deposit a coating onto a surface thereof; and, applying a coating solution to said heated portion of the moving metal substrate along a continuous line of thermal deposition, said coating solution applied along said continuous line of thermal deposition and forming said continuous coating on contact with said heated portion of the moving metal substrate.

46. The process recited in claim 45 wherein said moving metal substrate is a rod.

47. The process recited in claim 45 wherein said moving metal substrate is a tube.

48. The process recited in claim 45 wherein said moving metal substrate is wire.

49. The process recited in claim 45 herein said moving metal substrate is a band.

* * * * *